United States Patent [19]

Krause, Jr. et al.

[11] 4,437,522

[45] Mar. 20, 1984

[54] SELECTIVE LOCK FOR ANCHORING WELL TOOLS

[75] Inventors: William F. Krause, Jr., Spring; Mark E. Hopmann, Houston, both of Tex.

[73] Assignee: Baker Oil Tools, Inc., Orange, Calif.

[21] Appl. No.: 346,674

[22] Filed: Feb. 8, 1982

[51] Int. Cl.[3] ..... E21B 23/02

[52] U.S. Cl. ..... 166/382; 166/217; 166/237

[58] Field of Search ..... 166/382, 387, 140, 237, 166/208, 216, 217, 118, 214, 215; 285/315, 18

[56] References Cited

U.S. PATENT DOCUMENTS

| | | | |
|---|---|---|---|
| 2,887,163 | 5/1959 | McGowen et al. | 166/217 |
| 3,002,565 | 10/1961 | Moore | 166/217 |
| 3,507,329 | 4/1970 | Stone | 166/217 X |
| 4,126,179 | 11/1978 | Long | 166/214 X |
| 4,295,528 | 10/1981 | Carmody | 166/382 |

*Primary Examiner*—Ernest R. Purser
*Assistant Examiner*—Michael Starinsky
*Attorney, Agent, or Firm*—Norvell & Associates

[57] ABSTRACT

The disclosure provides a method and apparatus for effecting the locking of a well tool in any selected one of a plurality of identical nipples provided in spaced relationship along a well tubing string. Each nipple is provided with an annular recess to receive expandable locking dogs carried by the locking mechanism and an upwardly facing no-go shoulder which is of no lesser diameter than the bore of the tubular string. The locking mechanism is shearably mounted on a running tool and incorporates an expansible C-ring which has a downwardly facing shoulder engagable, when expanded, with the no-go shoulder of the selected locking nipple. The expansible C-ring is held in a retracted position by a collet having spring arms which pass freely downwardly through any or all of the nipples but, when moved upwardly through a selected nipple, engage a surface on the nipple and pull the collet out of its retaining position with respect to the expansible C-ring. The C-ring expands into engagement with the upwardly facing no-go shoulder, thus permitting the application of a downward force to the locking mechanism which effects the shearing of shear pins holding a camming mandrel in an inoperative position with respect to the locking dogs. The camming mandrel is then moved downwardly by the running tool to expand the locking dogs into engagement with the locking recess, following which, the running tool may be removed from the locking mechanism by an upward pull which shears a second shear pin.

22 Claims, 8 Drawing Figures

SELECTIVE LOCK FOR ANCHORING WELL TOOLS

BACKGROUND OF THE INVENTION

1. Field of the Invention

The invention relates to a lock mechanism permitting the anchoring of a well tool, such as a flow control device, in any selected one of a plurality of identical nipples incorporated in the tubing string.

2. Description of the Prior Art

The prior art has recognized the desirability of permitting oil well tools, such as flow control devices, to be located and locked in any selected one of a plurality of vertical positions in a tubing string. Prior art selective locking devices have employed a complex running tool to insert and actuate the locking mechanism to engage in the proper locking recess in the tubing string. This necessarily required the incorporation of shiftable elements, retaining springs and the like in the running tool and hence added to the expense of such tool and detracted from the reliability of the tool in effecting the selective locking of a well tool in a desired position along a tubing string. Still other locking devices employ no-go shoulders which constrict the bore of the tubing string.

Typical of prior art selective locking devices employing a no-go shoulder in each of the landing nipples is the mechanism described and illustrated in U.S. Pat. No. 4,295,528 and assigned to the Assignee of this application. U.S. Pat. Nos. 3,677,346 and 3,670,821 each disclose selective locks which rely to a significant extent upon utilization of a specialized running tool.

The locking assembly disclosed herein can be actuated using conventional running and pulling tools. These conventional running and pulling tools comprise tools capable of imparting only simple up or down axial movement to wireline actuable tools such as locks. Shear pins interconnecting these conventional running tools are also employed with these shear pins being capable of transferring sufficient force to the wireline tools to permit desired manipulation. After this desired manipulation is complete, application of additional force will shear the pins and release the wireline tool from the running tool for removal.

SUMMARY OF THE INVENTION

In accordance with this invention locking mechanism carrying the desired well tool on its bottom end is simply mounted to a running tool by shear screws. The locking mechanism incorporates an expansible C-ring which has a downwardly facing shoulder engagable, when expanded, with the upwardly facing no-go shoulder in any selected one of a plurality of identical locking nipples. The locking C-ring is retained in an inoperative position by an axially shiftable collet. During the insertion movement of the locking mechanism, the depending spring arms of the retention collet pass freely over any obstructions encountered in the bore of the tubing string and the collet retains the expansible C-ring in its contracted position. However, upon passage through any one of the locking nipples, followed by elevation of the locking device, the spring arms of the collet engage with a downwardly facing nipple surface to shift downwardly and remove the restraint from the expansible C-ring, permitting the C-ring to spring outwardly into engagement with the upwardly facing no-go shoulder in the nipple. The subsequent imposition of a downward force to the locking mechanism will then shift the locking keys radially outwardly to effect a locking engagement with the annular locking recess in the nipple. The running tool is then removed from the locking mechanism through the application of an additional upward force which effects the severance of shear screws securing the locking mechanism to the running tool.

In accordance with this invention, a plurality of nipples having identical internal contours are provided in spaced relationship along a tubing string corresponding to the anticipated locations of various well tools, such as flow control devices. None of the locking nipples incorporates a no-go shoulder which would in any manner reduce the internal bore of the tubing string. Each nipple does define an annular locking recess within which expandable dog elements of the locking mechanism may be inserted. Additionally, in axially spaced relationship to the annular locking recess, each nipple is provided with a second annular recess defining an upwardly facing no-go shoulder which shoulder does not, however, project into the bore of the tubing string.

It is therefore apparent that the invention further incorporates a unique method of emplacing the locking mechanism in a selected nipple.

Further objects and advantages of the invention will be readily apparent to those skilled in the art from the following detailed description, taken in conjunction with the annexed sheets of drawings, on which is shown a preferred embodiment of the invention.

BRIEF DESCRIPTION OF THE DRAWINGS

FIGS. 1B and 1C respectively constituting vertical continuations of FIGS. 1A and 1B.

FIG. 3B being a vertical continuation of FIG. 3A.

DESCRIPTION OF THE PREFERRED EMBODIMENT

Figure 2A:
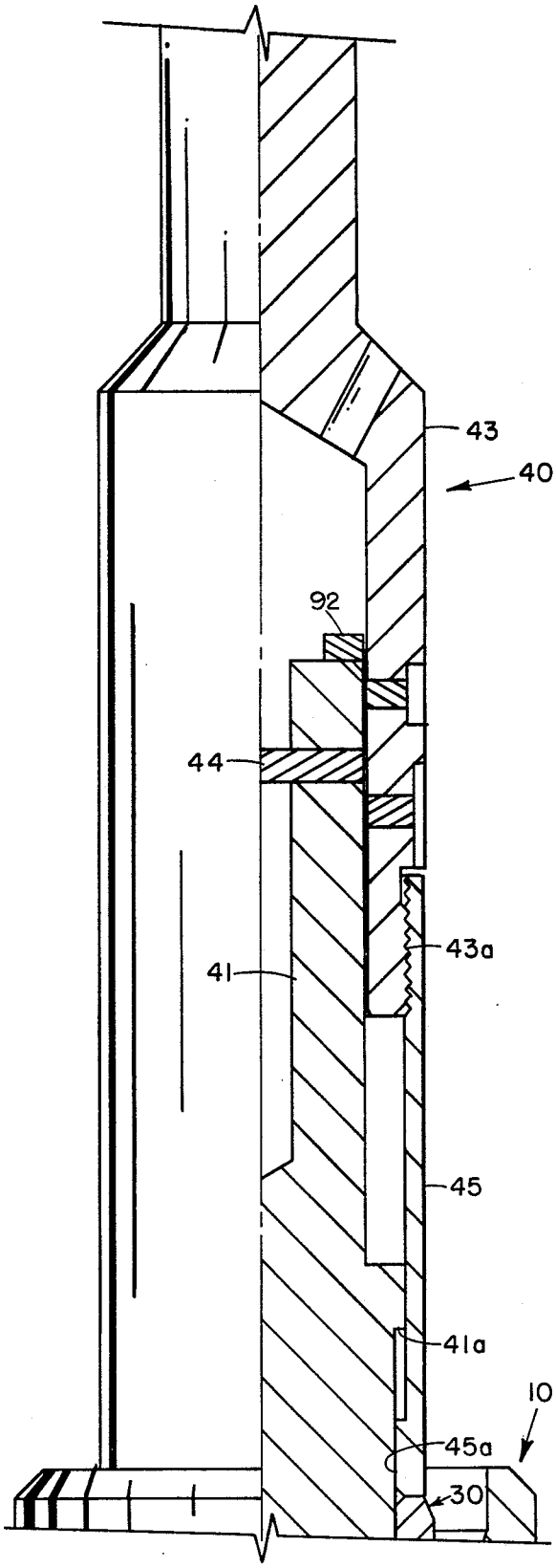
FIGS. 2A, 2B and 2C are views respectively corresponding to FIGS. 1A, 1B and 1C but showing the elements of the locking mechanism in their expanded or locked position.
Figure 1A:
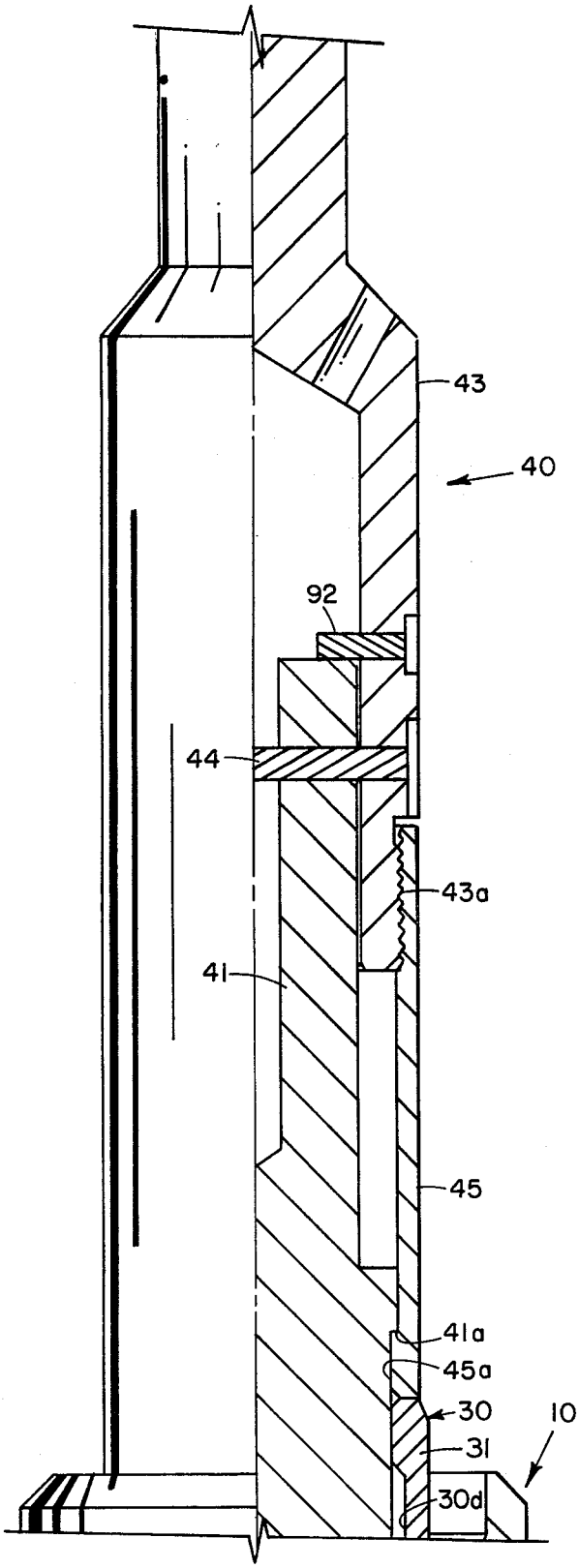
FIGS. 1A, 1B and 1C collectively represent a vertical cross-sectional view of a locking mechanism embodying this invention shown in inserted relationship with respect to a locking nipple and supported on a running tool, with the elements of the locking mechanism being in their retracted or inactive positions.
Figure 1B:
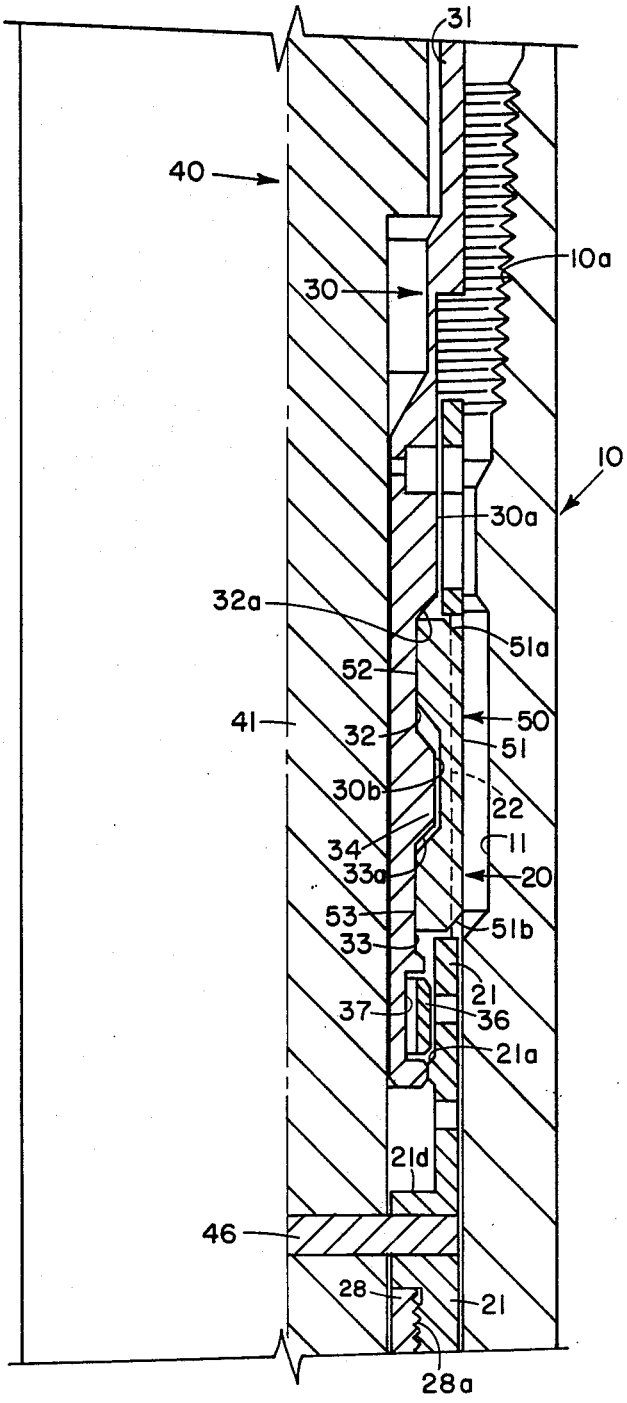
Figure 1C:
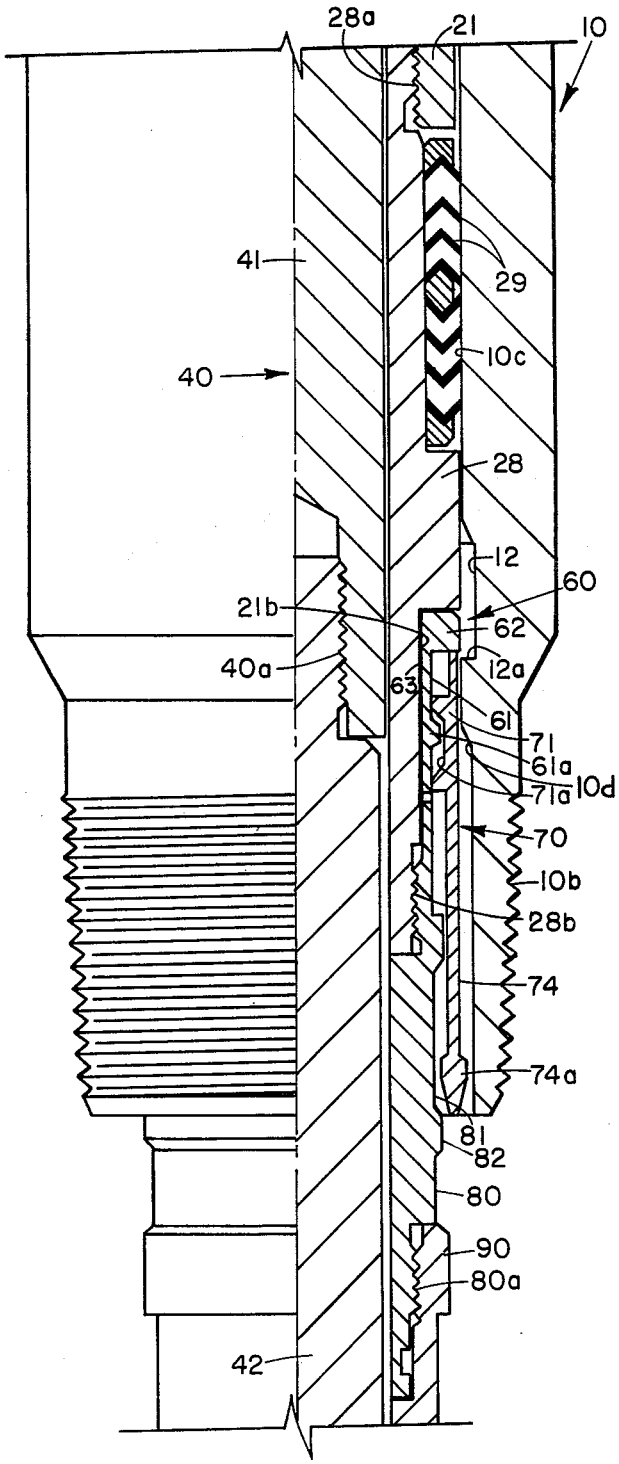
Figure 3A:
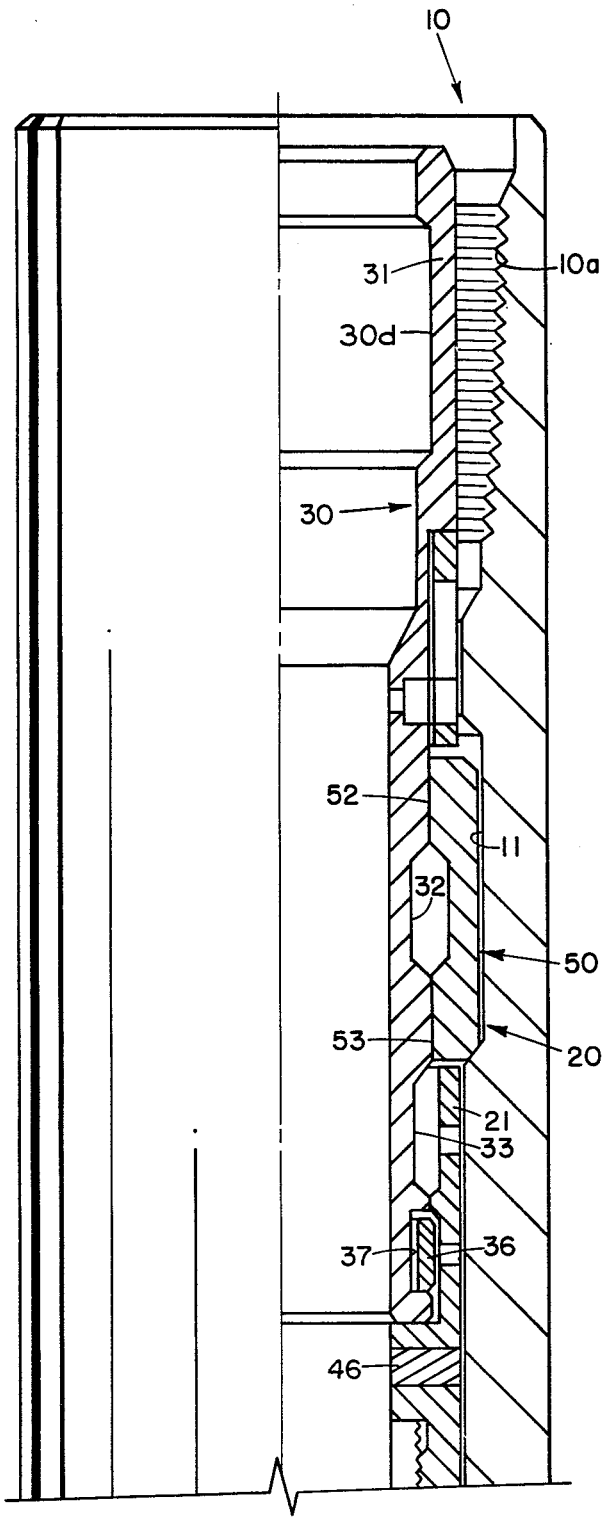
FIGS. 3A and 3B collectively constitute a vertical sectional view of the locking mechanism embodying this invention shown in locked relationship to a well nipple and with the running tool removed.
Figure 3B:
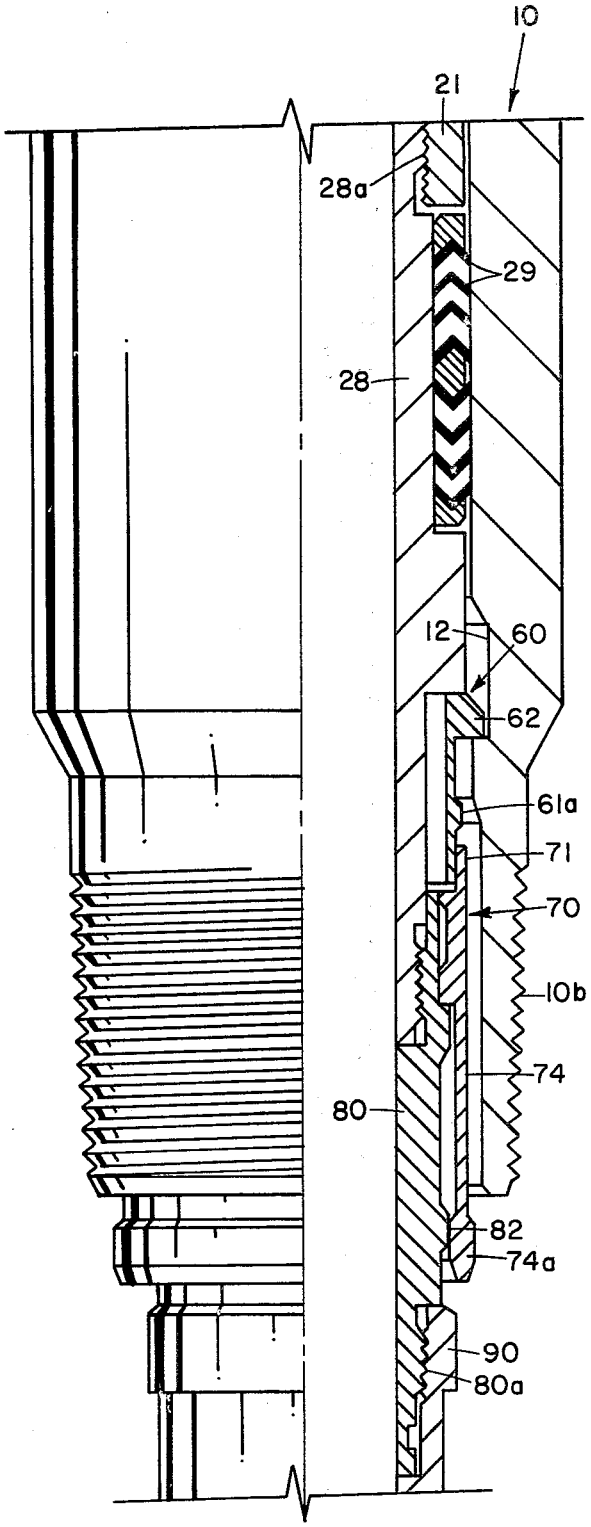

Referring to FIGS. 1A, 1B and 1C of the drawings, there is illustrated a selective locking mechanism 20 embodying this invention shown in a run in position with respect to a selected locking nipple 10 in a well conduit. In this position, the locking mechanism 20 is supported by and secured to a running tool 40 which in turn is connected by a connecting sub 43 to a suitable wire line (not shown).

The locking nipple 10 (FIG. 1B and FIG. 1C) embodying this invention is provided at opposite ends with conventional internal threads **10*a* and external threads 10*b* for incorporation into well conduit such as a tubing string. Since all of the locking nipples 10 are identical, any number of such nipples may be incorporated in the well conduit at a number of desired locations. Each locking nipple 10 defines an annular locking recess 11**.

Below recess 11, a second annular recess 12 defines an upwardly facing generally radial no-go shoulder 12*a*. It should be noted, however, that no-go shoulder 12*a* does not in any manner diminish the diameter of the conduit of the bore 10*c* of the locking nipple 10.

The running tool 40 comprises a threaded assemblage 40*a* (FIG. 1C) of an upper body element 41 and a lower body element 42. The connecting sub 43 is secured to the top portion of the upper body 41 by one or more radially disposed shear pins 44. The upper portion of connecting sub 43 is conventionally connected to a wire line (not shown). The lower end of the connecting sub 43 is provided with external threads 43*a* for securing thereto a downwardly extending sleeve 45 which establishes a lost motion connection between the connecting sub 43 and the upper body 41 by virtue of an internally projecting shoulder 45*a* engaging an externally projecting shoulder 41*a* on upper body 41 so that even when the shear pins 44 are severed, the entire running tool assemblage may still be removed from the well by the wire line. The severance of the shear pins 44 does, however, permit the sleeve 45 to move downwardly relative to the remainder of the running tool 40.

The locking mechanism 20 includes a tubular housing 21 having a plurality of circumferentially spaced windows 22. A plurality of locking dogs 50 are respectively mounted in the windows 22 for radial movements between a retracted position, (FIG. 1B) wherein the dogs are freely insertable through the bore 10*c* of the locking nipple 10 to an expanded position (FIG. 2B) wherein the dogs are engaged in the locking recess 11. The exterior surface 51 of the locking dogs 50 is contoured to permit such dogs to conform to the locking recess 11. Such contour includes inclined surfaces 51*a* and 51*b* respectively at the top and bottom ends of the locking dogs to permit the dogs to be readily cammed inwardly by the correspondingly shaped end walls of recess 11 when removal of the locking mechanism is required.

The lower portion of the tubular housing 21 includes a seal mounting sub 28 which is secured by threads 28*a* to the bottom end of the window containing housing portion 21. A conventional stack of chevron seals 29 are mounted on the seal mounting sub 28 and sealingly engage the internal bore 10*c* of the locking nipple 10. The lower end of the seal mounting sub 28 is threadably secured by threads 28*b* to a connecting sub 80 which in turn is secured by threads 80*a* to the top portion 90 of a well tool which is to be mounted in the tubular conduit. Generally, such well tool comprises a flow control valve and hence forms no part of this invention and is not illustrated nor need it be further described.

Figure 2B:
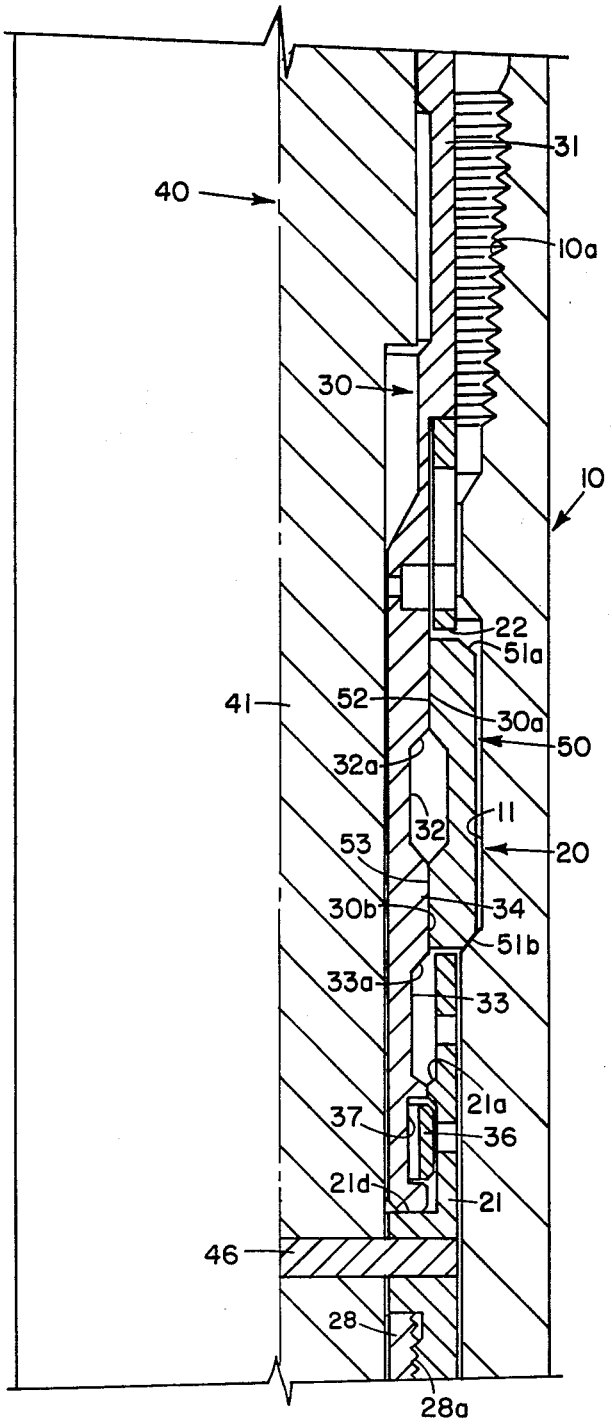

A hollow mandrel 30 is provided which is slidably mounted on running tool 40 and inserted within the annular housing 21 and hence underlies the locking dogs 50. Mandrel 30 is provided with an upwardly projecting fishing neck 31. In the run-in position, the top of fishing neck 31 is abutted by the bottom face of the sleeve 45 of the running tool. Mandrel 30 is further provided with a pair of axially spaced recesses 32 and 33 which have inclined upper surfaces 32*a* and 33*a* respectively. The recesses 32 and 33 are separated by an annular shoulder 34. Each locking dog 50 has a radially interior surface contoured to permit the dogs to lie in a retracted position with radially inward dog projections 52 and 53 respectively engaged in recesses 32 and 33 (FIG. 1B). Downward relative movement of the mandrel 30 with respect to the dogs 50 will however effect the outward camming of such dogs through to a radially expanded position wherein the inwardly projecting portions 52 and 53 of the dogs 50 respectively ride on maximum diameter portions 30*a* and 30*b* of mandrel 30 immediately above the recesses 32 and 33 (FIG. 2B).

Relative axial movement of the annular housing 21 and the mandrel 30 is normally resisted by an expansible C-ring 36 which is located within an annular slot 37 provided on the bottom portions of the mandrel 30. In this position, the C-ring 36 also engages an upwardly facing inclined shoulder 21*a* formed on the annular housing 21; hence the mandrel 30 is effectively secured against relative downward motion with respect to housing 21 until the imposition of a significant downward force to mandrel 30 sufficient to effect the compression of the C-ring 36 and permit it to pass under the inclined shoulder 21*a* of the housing 21.

In the run-in position, the annular housing 21 is further directly secured to the running tool 40 by one or more radially disposed shear pins 46. Pins 46 are designed with substantially higher shear strength than the shear pins 44 which secure the connecting sleeve 43 to the upper body sleeve of the running tool 40.

Figure 2C:
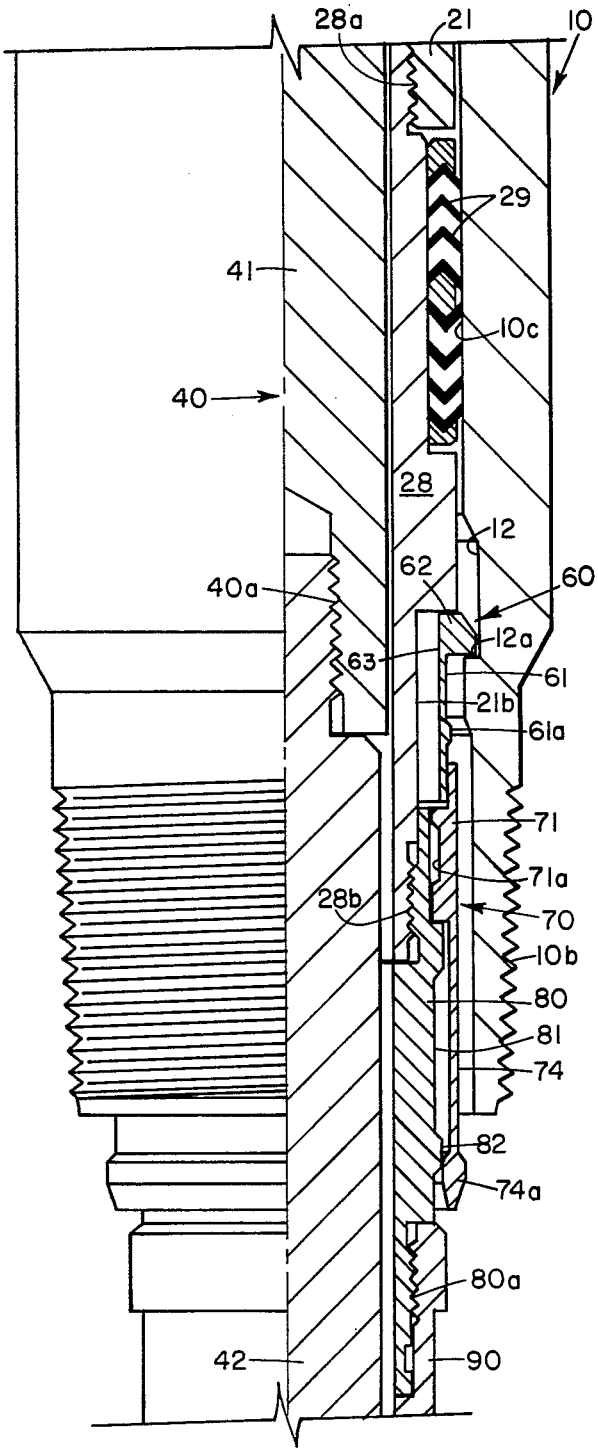

Locking engagement of dogs 50 in an annular recess 11 in a selected locking nipple 10, requires a means of positioning the locking mechanism 20 relative to, and selecting the desired locking recess 11. Such positioning is accomplished by a circumferentially expansible mechanism 60 (FIG. 1C) which engages the upwardly facing nipple no-go shoulder 12*a*. Mechanism 60 preferably comprises an expansible C-ring 61 having a cylindrical body portion 63 surrounding a reduced diameter lower portion 21*b* of the annular housing 21. The expansible C-ring 61 is further provided with a plurality of peripherally spaced, radially projecting lugs 62 which, when the C-ring 60 is permitted to expand, effect a locking engagement with the no-go shoulder 12*a* of the selected locking nipple 10. The C-ring 61 is inwardly collapsible (FIG. 1C) and outwardly urged and expansible (FIG. 2C).

The expansible locking element 60 is maintained in a contracted position by a collet 70 having a ring portion 71 snugly surrounding the cylindrical portion 63 of the expansible C-ring 61 in the run-in position. Ring portion 71 is provided with an internal annular recess 71*a* which receives a projecting rib 61*a* formed on cylindrical portion 61 of the expansible C-ring 60 and thus retains the collet 70 against axial displacement with respect to the expansible C-ring 61. However, the projecting shoulder 61*a* and the recess 71*a* are provided with cooperating inclined end faces so that upon the occurrence of a significant axial force applied to the collet 70, the ring portion 71 will compress the expansible C-ring 61 sufficiently to permit passage of the retaining lug 61*a* out of the recess 71*a*.

Collet 70 is axially shiftable downward from the position shown in FIG. 1C relative to annular housing 21 and includes a plurality of peripherally spaced resilient arm portions 74, each of which terminates in an enlarged head portion 74*a*. In the run-in position of the locking tool, the enlarged head portions 74*a* are positioned opposite an annular recess 81 formed in the connecting sub 80 which is threadably secured by the threads 28*b* to the bottom end of the seal mounting sub 28. The depth of recess 81 is sufficient to permit the enlarged end portion 74*a* of the collet arm portion 74 to freely enter the bore of the conduit, including the bore 10*c* of the locking nipple 10. If, however, after passing through a selected locking nipple 10, the motion of the running tool 40 is reversed to elevate the apparatus carried thereby, the enlarged collet head portion 74*a* will engage with a downwardly facing shoulder 10*d* formed in the lower portions of the locking nipple 10 and such engagement will produce an upward shifting of the housing assemblage 21 sufficient to bring an external shoulder 82 on the connecting sub 80 into alignment with the enlarged head portion 74*a*, (FIG. 2C) thus preventing the head portion 74*a* from being cammed inwardly hence collet 70 is trapped and continued upward motion of the collet 70 with the lock mechanism is no longer possible. This permits the ring portion 71 of the collet 70 to snap over the retaining lug 61*a* provided on the expansible C-ring 61 and move relatively downwardly. Thus the C-ring 61 is freed to expand outwardly. If the running tool 40 is then lowered, the lugs 62 of expansible C-ring 61 will effect a locking engagement with the no-go shoulder 12*a* provided in the locking nipple 10.

When the expansible C-ring 61 solidly engages the no-go shoulder 12*a*, the application of a downward force to the running tool 40 will effect the shearing of the shear pin 44 which prevented downward motion of the connecting sleeve 43 relative to the balance of the running tool. Such downward motion is now permitted and results in the mandrel 30 being shifted downwardly by sleeve 45 to outwardly displace the locking segments 50 into engagement with the locking recess 11 provided in the selected locking nipple 10. Such downward movement also effects an expansion of the retaining C-ring 36, permitting it to move downwardly over the retaining shoulder 21*a* and occupy the position illustrated in FIG. 2B. The retaining C-ring 36 now is positioned below the shoulder 21*a* and the bottom end of the mandrel 30 abuts an internal shoulder 21*a* on mandrel 21 and prevents further relative displacement of the mandrel 30 relative to the housing 21.

The tool 90 supported by the aforedescribed locking mechanism 20 is thus secured within the selected locking nipple 10 and the seals 29 prevent fluid leakage between the locking mechanism and the bore 10*c* of the locking nipple.

To remove the running tool, an upward force is then imposed on the connecting sleeve 43. The downwardly extending sleeve 45 effectively has a lost motion connection with the upper body 41 of the running tool 40 and hence the upward force is applied to the interconnected upper and lower body portions 41 and 42. This upward force effects a shearing of the shear pin 46 which traverses the annular housing 21 and the upper body portion 41, thus permitting the entire running tool 40 to be removed.

To assist the operator in determining that a locking engagement has been achieved, a stop pin 92 may be provided in the connecting sleeve 43 which projects into the path of the top end of the upper body 41 as the connecting sleeve 43 moves downwardly. Pin 92 functions as a tell tale to the operator to indicate that the running tool has been lowered sufficiently to expand dogs 50.

Thus the locking mechanism may be engaged with any selected one of the nipples 10 provided along the length of the tubular conduit. In fact, if the operator goes through a particular locking nipple 10 and then decides to effect the setting of the inserted tool in a nipple located above the selected nipple, the herein described apparatus will permit such motion since the locking dogs are not expanded until the expansible C-ring 61 engages a no-go shoulder 12*a* in a locking dog.

Once the mechanism is attached to a selected locking nipple, it can be released therefrom through the simple expedient of running a wire line tool into the well and engaging a fishing neck recess 30*d* provided in the upper fishing neck portion 31 of mandrel 30. An upward pull on such fishing neck recess will effect an upward movement of the mandrel 30 relative to the housing 21 and thus move the recesses 32 and 33 into alignment with the internal projections 52 and 53 provided on the locking dogs 50, permitting the dogs to be cammed radially inwardly to release the locking assemblage for removal from the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A lock for securing a well tool in a selected one of a plurality of identical landing nipples in a well conduit, said lock comprising: an annular housing having means thereon for supporting said well tool; a plurality of radially expandable locking dogs for engaging said nipple to secure said well tool thereto when subjected to axial loads in either direction; an outwardly urged inwardly collapsible means engagable with said nipple upon outward expansion to prevent movement of said annular housing in a first axial direction relative to said nipple; an axially shiftable member movable in said first axial direction relative to said annular housing from a position initially in compressive engagement to hold said collapsible means in an inwardly retracted position and having means for engaging said nipple during movement of said lock in a second opposite axial direction to release said collapsible means; and camming means for outwardly urging said radially expandable locking dogs, said camming means being shiftable in said first direction relative to said annular housing upon engagement of said collapsible means with said nipple.

2. The lock of claim 1 wherein said axially shiftable member comprises an inwardly flexible member for initially permitting movement of said lock in said first direction past identical landing nipples.

3. The lock of claim 2 wherein said inwardly flexible means comprises means for engaging a surface on said nipple facing in said first direction upon reversal of said lock and movement in said second direction.

4. The lock of claim 3 wherein said axially shiftable member abuts a radially extending surface on said collapsible means where said collapsible means is in an initial inwardly collapsed configuration thereby preventing movement of said axially shiftable member in said second direction relative to said collapsible means.

5. The lock of claims 1, 2, 3 or 4 wherein said axially shiftable member comprises a collet.

6. The lock of claim 1 wherein said collapsible means comprises a cylindrical member having an axially extending slot.

7. The lock of claim 6 wherein said collapsible means has a radially extending surface facing in the first axial direction for engaging a surface on said nipple facing in the second axial direction.

8. The lock of claim 7 wherein said axially shiftable member abuts said radially extending surface when in an initial configuration.

9. The lock of claim 1 wherein said camming means comprises camming surfaces on a inner mandrel shiftable in the first direction.

10. The lock of claim 9 wherein said inner mandrel is axially shiftable in the first direction on the interior of said locking dogs to radially cam said locking dogs to the expanded configuration.

11. The lock of claim 10 wherein said inner mandrel is shiftable in the second direction to disengage said locking dogs, said collapsible means being inwardly flexible to permit movement of said lock in said first direction.

12. The lock of claims 1, 2, 3, 4, 6, 7, 8, 9, 10 or 11 wherein said first direction is down and said second direction is up.

13. A lock mechanism for securing a well tool in a select one of a plurality of identical landing nipples in a well conduit, said lock comprising: a running tool for selectively imparting movement to said lock in opposite first and second axial directions; an annular housing, having means thereon for supporting said well tool; a plurality of radially expandable locking dogs for engaging said nipple to secure said well tool thereto when subjected to axial loads in either direction; an outwardly urged inwardly collapsible means engagable with said nipple upon outward expansion to prevent movement of said annular housing in a first axial direction relative to said nipple; an axially shiftable member movable in said first axial direction relative to said annular housing from a position initially in compressive engagement to hold said collapsible means in an inwardly retracted position and having means for engaging said nipple during movement of said lock in a second opposite axial direction to release said collapsible means; and camming means for outwardly urging said radially expandable locking dogs, said camming means being shiftable in said first direction relative to said annular housing upon engagement of said collapsible means relative to said annular housing upon engagement of said collapsible means with said nipple.

14. A lock mechanism as claimed in claim 13 further comprising shearable means extending between said running tool and said annular housing.

15. A locking assembly for securing a well tool in a well conduit, said locking assembly comprising: a landing nipple incorporable in said well conduit, said landing nipple having an annular locking recess, an axially spaced, recessed, upwardly facing no-go shoulder and a downwardly facing shoulder axially spaced from said no-go shoulder; a shiftable lock member further comprising: an annular housing having means thereon for suppporting said well tool; a plurality of radially expandable locking dogs being contoured to engage said locking recess upon outward expansion thereof to secure said lock member to said landing nipple; an outwardly urged, inwardly collapsible member having a downwardly facing surface engagable with said no-go shoulder upon outward expansion thereof to prevent additional downward movement of said lock member relative to said landing nipple; an axially shiftable member initially in compressive engagement to retain said collapsible member in an inwardly retracted configuration and being engagable with said downwardly facing shoulder on said landing nipple upon upward movement of said lock member to release said collapsible member; and an axially shiftable camming member being movable downwardly beneath said locking dogs to outwardly expand said locking dogs upon engagement of said collapsible member with said no-go shoulder.

16. A lock for securing a well tool in a selected one of a plurality of landing nipples in a well conduit, each said nipple defining an upwardly facing internal no-go shoulder of diameter not less than the conduit bore and an annular locking recess above the no-go shoulder having a diameter greater than the conduit bore, comprising: an annular housing having means on its lower end for supporting a well tool; a plurality of locking dogs mounted for radially expandable movement, the radially outer portions of said dogs being contoured to enter said nipple locking recess; a mandrel insertable in said annular housing and axially shiftable relative thereto, camming means on said mandrel engagable with said locking dogs by axial relative movement to shift said dogs from a radially retracted to a radially expanded position; a wire line supported running tool insertable in the bore of said mandrel and having a sleeve portion abutting the top of said mandrel, first shearable means securing said sleeve portion to said running tool, a second shearable means securing said annular housing to said running tool, whereby said locking dogs remain in their radially retracted position during run-in; peripherally expansible means on said annular housing engagable when expanded with said upwardly facing nipple no-go surface, collet means on said annular housing adjacent said peripherally expansible means, said collet means having a ring portion overlying said peripherally expansible means to hold same in a non-expanded position, and spring arm portions on said collet freely passable downwardly through any of said nipples but engaging the selected nipples when moved upwardly into the selected nipple by the running tool, thereby releasing said peripherally expansible means from said collet ring portion to engage said nipple no-go shoulder by subsequent downward movement of said running tool, thereby permitting downward movement of said running tool to shear said first shearable means and expand said locking dogs into said nipple locking recess and subsequent upward movement of said running tool to shear said second shearable means and permit removal of said running tool.

17. The lock of claim 16 wherein said peripherally expansible means comprises a resilient C-ring having a plurality of peripherally spaced, radially projecting shoulders formed thereon and engagable with said nipple no-go shoulder when the C-ring is expanded.

18. The lock of claim 16 wherein said sleeve portion of said running tool defines a lost motion connection between the running tool and its supporting wire line, thereby permitting removal of the running tool after shearing of said first shearable means.

19. The lock of claim 16 plus external sealing means on said annular housing engagable with the nipple bore intermediate said no-go shoulder and said annular locking recess.

20. The lock of claim 17 wherein said C-ring has an axially extending cylindrical portion having a projecting peripheral rib formed thereon, said collet ring portion overlying said cylindrical portion in the non-expanded position of said C-ring and having an annular recess receiving said peripheral rib to yieldably restrain said collet against axial movements relative to said C-ring.

21. A method of positioning a locking device having radially shiftable locking dogs in a selected one of a plurality of identical landing nipples in a well conduit in a subterranean well each nipple having a locking recess contoured to receive said locking dogs, comprising the steps of lowering the locking device secured to the locking device through the well conduit to a position immediately below the selected landing nipple;

raising the locking device to shift an axially movable member engaging the nipple downwardly relative to the locking dogs to release an outwardly urged initially collapsible member initially compressed in an inwardly collapsed position by the axially movable member and to position the locking dogs adjacent to the locking recess; and expanding the locking dogs by shifting a camming member downward relative to the locking dogs after the collapsible member expands to said nipple to prevent downward movement to the locking dogs.

22. A method of positioning a locking device having radially shiftable locking dogs in a selected one of a plurality of identical landing nipples positioned along a tubing string of a subterranean well, each of said nipples having an upwardlfy facing no-go shoulder with an internal diameter not less than the internal diameter of the tubing string and an annular locking recess located above said no-go shoulder having an internal diameter greater than the tubing string internal diameter, the method comprising the steps of:

lowering through the tubing string a running tool having said locking device secured thereto by shearable pins and with the locking dogs disposed in a retracted position, the locking device further including a radially expansible member engagable with the no-go shoulder in its expanded position but retained in a retracted position by the ring portion of a collet;

passing the collet of the locking mechanism downwardly through the selected locking nipple and then raising the locking mechanism to engage the collet arm portions with a downwardly facing surface on the locking nipple, thereby shifting the ring portion of the collet with respect to the expansible member and permitting such member to expand;

lowering the running tool and the locking device to engage the expanded member with the no-go shoulder of the selected nipple;

applying a downward force from the running tool to the locking device to expand the locking dogs into engagement with the locking recess of the selected nipple; and then elevating the running tool to shear the shearble pins connecting the locking device and the running tool to permit removal of the running tool.

* * * * *